US007470301B2

(12) United States Patent
Heydens

(10) Patent No.: US 7,470,301 B2
(45) Date of Patent: Dec. 30, 2008

(54) CLEANABLE DEVICE FOR DEPOLLUTION OF ENGINE EXHAUST GASES

(75) Inventor: Jacques Heydens, Exincourt (FR)

(73) Assignee: Faurecia Systems d'Echappement, Nanterre (FR)

( * ) Notice: Subject to any disclaimer, the term of this patent is extended or adjusted under 35 U.S.C. 154(b) by 483 days.

(21) Appl. No.: 10/513,478

(22) PCT Filed: May 7, 2003

(86) PCT No.: PCT/FR03/01422

§ 371 (c)(1),
(2), (4) Date: Jun. 30, 2005

(87) PCT Pub. No.: WO03/095806

PCT Pub. Date: Nov. 20, 2003

(65) Prior Publication Data

US 2006/0010861 A1 Jan. 19, 2006

(30) Foreign Application Priority Data

May 7, 2002 (FR) ..... 02 05742

(51) Int. Cl.
*B01D 46/00* (2006.01)
*B01D 35/30* (2006.01)
*F01N 3/021* (2006.01)

(52) U.S. Cl. ..... 55/523; 55/282.3; 55/385.3; 55/502; 55/503; 55/524; 55/DIG. 5; 55/DIG. 10; 55/DIG. 30; 95/273; 60/297; 60/311; 60/322

(58) Field of Classification Search ..... 55/282.2, 55/282.3, 385.3, 502, 503, 523, 524, DIG. 5, 55/DIG. 10, DIG. 30; 95/273, 278; 60/297, 60/299, 301, 303, 311, 322; 422/177, 180
See application file for complete search history.

(56) References Cited

U.S. PATENT DOCUMENTS

| | | | | |
|---|---|---|---|---|
| 2,273,210 | A * | 2/1942 | Lowther et al. | 55/503 |
| 4,352,408 | A | 10/1982 | Hardt et al. | |
| 4,450,682 | A * | 5/1984 | Sato et al. | 55/523 |
| 4,504,294 | A * | 3/1985 | Brighton | 55/502 |
| 4,927,608 | A * | 5/1990 | Worner et al. | 422/180 |
| 6,632,406 | B1 * | 10/2003 | Michelin et al. | 422/177 |
| 7,100,736 | B2 * | 9/2006 | Flintham | 181/243 |

(Continued)

FOREIGN PATENT DOCUMENTS

DE 1 294 393 * 6/1965

(Continued)

*Primary Examiner*—Jason M Greene
(74) *Attorney, Agent, or Firm*—Young & Thompson

(57) ABSTRACT

A device for depolluting a heat engine exhaust gases includes an outer casing (23) delimiting an exhaust gas circulating passageway and a particle filter (20) mounted in the passageway. The casing (23) includes a transverse break (34) along its entire periphery, the break (34) dividing the casing (23) into first and second successive segments (38, 40). The first and second successive segments (38, 40) include two mutually engaged ends. One outer end of the first segment (38) overlaps one inner end of the second section (40) along part of the length of the flow passageway. The outer end of the first segment (38) includes along its periphery at least one weakened region (50) for varying the cross-section of the outer end of the first segment (38). The device is applicable to motor vehicles.

19 Claims, 6 Drawing Sheets

U.S. PATENT DOCUMENTS

| | | | | |
|---|---|---|---|---|
| 7,160,519 | B1 * | 1/2007 | Norby et al. | 422/168 |
| 7,241,329 | B2 * | 7/2007 | Weber | 95/278 |
| 2004/0170541 | A1 * | 9/2004 | Flehmig et al. | 422/180 |
| 2006/0045824 | A1 * | 3/2006 | Foster et al. | 422/177 |

FOREIGN PATENT DOCUMENTS

| | | |
|---|---|---|
| DE | 12 94 393 | 5/1969 |
| DE | 199 59 955 | 6/2000 |
| GB | 312 200 | 5/1929 |

* cited by examiner

CLEANABLE DEVICE FOR DEPOLLUTION OF ENGINE EXHAUST GASES

The present invention relates to a device for depolluting the exhaust gases of a heat engine of the type comprising an outer casing delimiting a passage for the circulation of exhaust gases and a particle filter mounted in said passage, said casing comprising a transverse break along all of its periphery, which break divides the casing into successive first and second segments, the first and the second successive segments comprising mutually engaged ends, one outer end of the first segment overlapping one inner end of the second segment along part of the length of the circulation passage.

Devices of this type are used, in particular, for depolluting diesel engines of motor vehicles.

Such a device commonly comprises a catalytic purification member and a particle filter, arranged in a single casing.

The catalytic purification member is adapted to treat pollutant emissions in the gas phase, while the particle filter is adapted to retain the soot particles emitted by the engine.

The particle filter operates in accordance with a sequence of filtering and regeneration phases. During the filtering phases, the soot particles emitted by the engine are deposited on the upstream face of the filter. During the regeneration phase, the soot particles, which are substantially composed of carbon, are burnt on the upstream face of the filter in order to restore its original properties to it.

In order to promote regeneration of the particle filter, a chemical agent that reduces the combustion temperature of the soot must be incorporated into the fuel fed to the engine. This chemical agent is a catalytic additive containing one or more metallic components in the form of organometallic compounds. Said compounds will subsequently burn in the combustion chamber of the engine and become deposited, in the form of oxides within the soot particles, on the upstream face of the particle filter.

During the regeneration phases of the particle filter, the metallic oxide residues, commonly known as ashes, are retained on the upstream face of the particle filter. Thus, if the depollution device is used for a prolonged period, the accumulation of ashes significantly reduces the properties of the particle filter and, in particular, its capacity to be regenerated. In the case of a depollution device installed on a diesel engine vehicle, the properties of the particle filter are noticeably reduced once the vehicle has driven more than 50,000 km.

Patent Application No. FR-2.787.137 discloses a device for depolluting exhaust gases in which the means for access to the upstream face of the particle filter comprise a break in the casing that is associated with detachable means for connecting the two successive segments of the casing.

The two successive segments of the casing are provided with connecting flanges. Strapping surrounds the two flanges and axially tightens the flanges against each other.

The presence of the flanges and the strapping means that the outer casing of the depollution device is relatively large in the radial direction, making it difficult to install the device in a vehicle.

The object of the invention is to propose a depollution device that is more compact.

For this purpose, the invention relates to a device for depolluting the exhaust gases of a heat engine, of the aforementioned type, characterised in that the outer end of the first segment comprises along its periphery at least one weakened zone allowing variation of the cross-section of said outer end of the first segment.

According to particular embodiments, the depollution device comprises one or more of the following characteristics:

- the device comprises a plurality of weakened zones distributed along the periphery of the first segment, which zones define between them support tongues on the inner end of the second segment;
- the tongue or each tongue comprises a divergent edge provided at its free end, which edge gradually moves from the second segment toward its free end;
- the tongue or each tongue comprises a boss protruding toward the second segment, which boss rests on the inner end of the second segment;
- the ends of the first and second segments comprise complementary protruding and hollow profile members for axially retaining the first and second segments;
- the device comprises strapping surrounding the first and second segments in the overlapping region thereof;
- the device comprises an O-ring inserted between the inner and outer ends of the first and second segments;
- the end of the upstream segment, viewed in the normal direction of flow into the circulation passage, extends inside the end of the downstream segment, viewed in the normal direction of flow into the circulation passage;
- the device comprises a catalytic purification member, said transverse break being provided between the particle filter and the catalytic purification member;
- the outer casing comprises a branch merging with said circulation passage upstream of the particle filter.

The invention also relates to a method for dissociating the first and second segments of a device as defined above, characterised in that it comprises a step involving the injection, into said circulation passage, of a fluid under pressure through said branch, in order to urge the first and second segments in opposite directions.

A better understanding of the invention will be facilitated by reading the following description, which is given solely by way of example and with reference to the drawings, in which.

Figure 1:
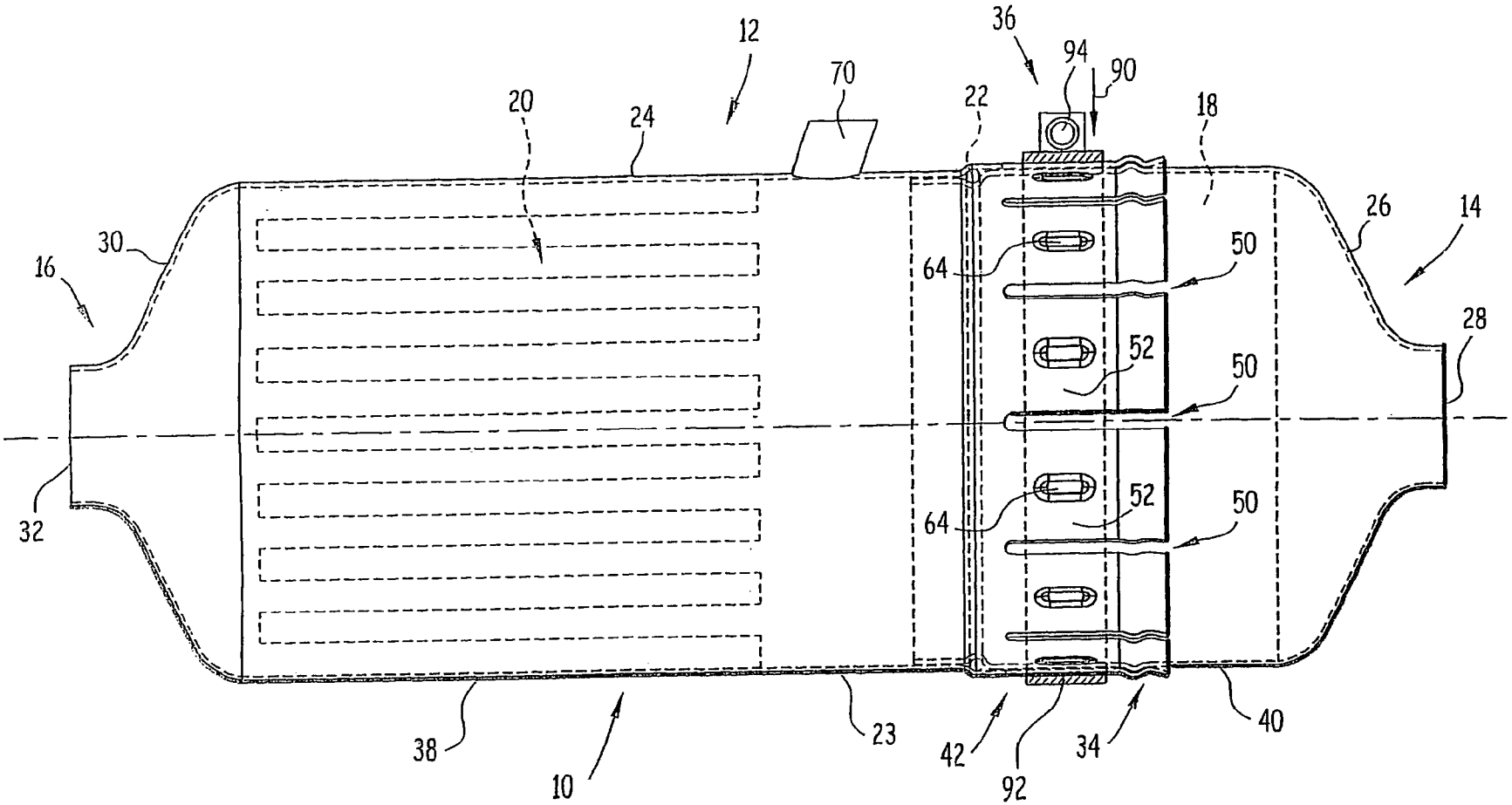
FIG. 1 is an elevated view of a device for depolluting exhaust gases according to the invention.
Figure 2:
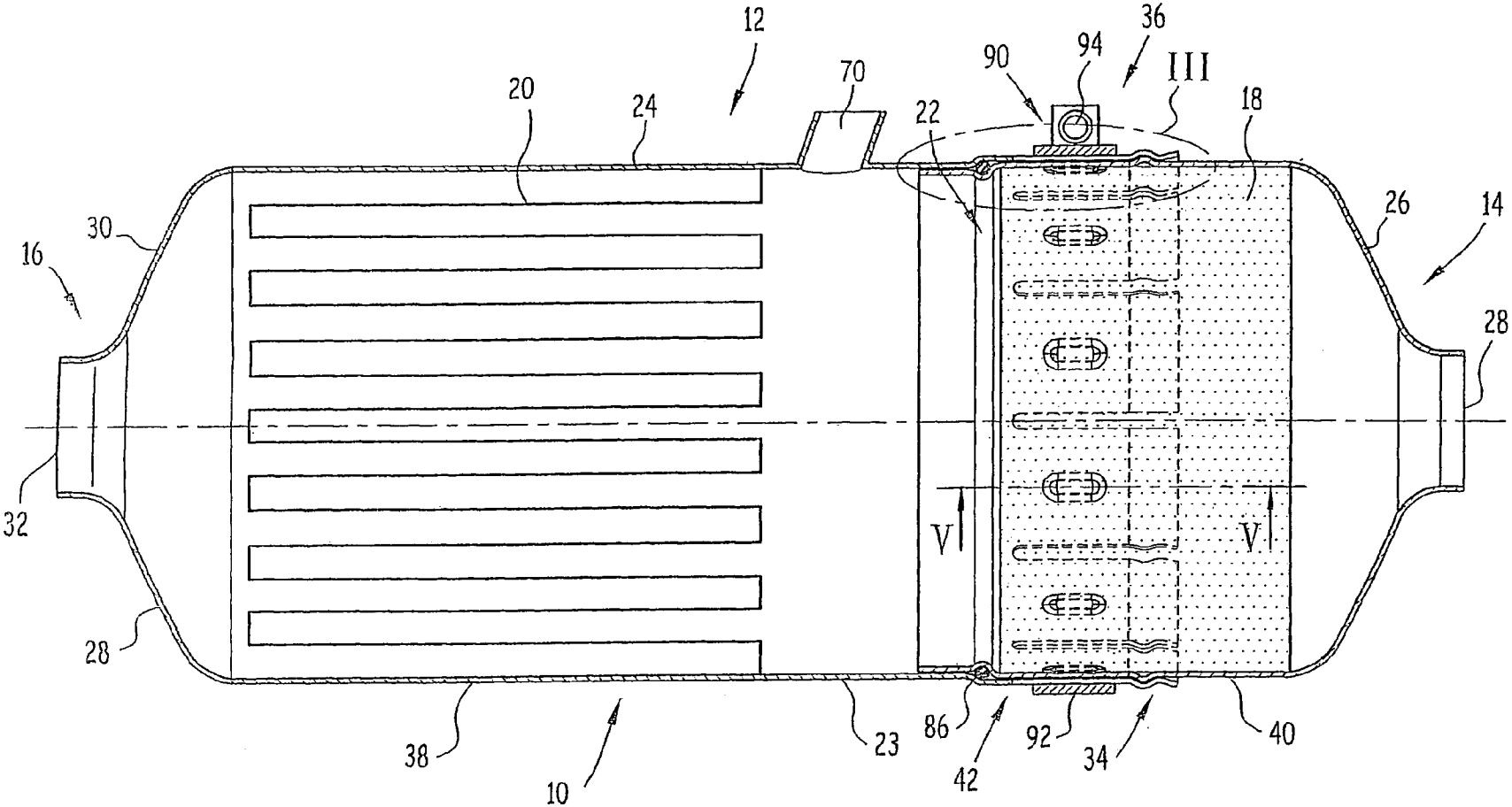
FIG. 2 is a longitudinal section, taken along the line II-II, of the depollution device of FIG. 1.

The depollution device 10, illustrated in FIGS. 1 and 2, comprises an exhaust pipe 12 that is generally cylindrical and has, at one end, an inlet 14 and, at its other end, an outlet 16. A catalytic purification member 18 and a particle filter 20, which are separated by a free transition space 22, are arranged in sequence from the inlet toward the outlet, inside the pipe 12.

The exhaust pipe 12 comprises an outer casing 23 delimiting a passage for the circulation of exhaust gases, through which the catalytic purification member 18 and the particle filter 20 are arranged.

The catalytic purification member 18 comprises, for example, a gas-permeable structure that is covered with catalytic metals promoting oxidation of the combustion gases and/or reduction of the nitrogen oxides.

The particle filter 20 is made of a filtering material comprising a monolithic ceramic or silicon carbide structure that is sufficiently porous to allow the passage of the exhaust gases. However, as is known per se, the diameter of the pores is selected so as to be sufficiently small for particles, and in particular soot particles, to be retained on the upstream face of the filter. The particle filter may also be made of a ceramic foam, cordierite or silicon carbide. It may also be composed of a cartridge filter or a sintered metal filter.

The particle filter that is used here comprises, for example, a set of parallel channels, which are divided into a first group of inlet channels and a second group of outlet channels. The inlet and outlet channels are arranged in a staggered manner.

The inlet channels open into the upstream portion of the particle filter and are closed in the region of the downstream portion of the particle filter.

The outlet channels, by contrast, are closed on the upstream portion of the particle filter and open into its downstream portion.

In its common part, the outer casing 23 is composed of a cylindrical wall 24 that is substantially consistent in section.

At its inlet end, the exhaust pipe comprises a divergent segment 26 that connects an inlet pipe 28 to the cylindrical wall 24. Similarly, at its trailing end, the cylindrical wall 24 is extended by a convergent segment 30 leading into an outlet pipe 32 delimiting the outlet 16.

During operation, the exhaust gases circulate first through the catalytic purification member 18, then through the particle filter 20.

Means for accessing the upstream surface of the particle filter 20 are provided along the length of the casing 23. Said means comprise a transverse break 34 in the casing, along its entire periphery, and detachable means 36 for connecting the two successive segments 38, 40 thus defined in the cylindrical wall 24, either side of the break 34.

In the illustrated embodiment, the detachable connecting means 36 extend around the catalytic purification member 18.

The end of the casing segment 40 is fitted inside the corresponding end of the casing segment 38.

The ends of the casing segments 38 and 40 thus overlap each other, the end of the upstream segment 40, viewed in the normal direction of flow into the circulation passage, extending inside the end of the downstream segment 38. The end of the upstream segment 40 is thus referred to as an inner end, while the end of the downstream segment 38 is referred to as its outer end.

In their common part, the two segments 38 and 40 exhibit identical sections.

Figure 4:
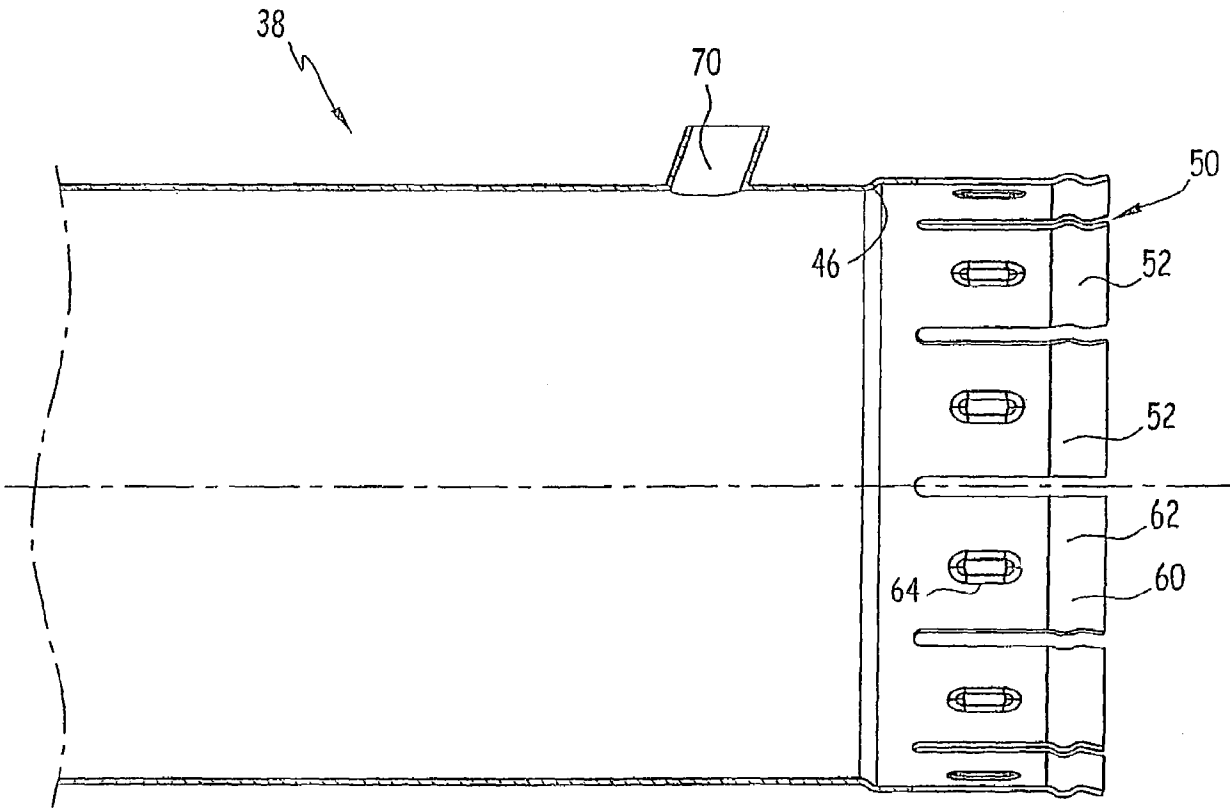
FIG. 4 is a partial longitudinal section of a segment of the casing of the depollution device.

As illustrated in FIG. 4, the tubular wall delimiting the segment 38 has an end segment 42 that is broadened in a generally cylindrical shape, with a larger diameter than the diameter of the common part of the segment 38. This broadened segment 42 forms the outer end of the segment, which end is suitable for receiving the inner end of the complementary segment. It defines an inner shoulder 46 with the rest of the segment 38.

According to the invention, the outer end comprises at least one weakened zone along its periphery, allowing variation in the section of this end and, more precisely, centripetal deformation of this end.

As illustrated in FIGS. 2 and 4, the weakened zones comprise notches 50 that are distributed uniformly at the outer end of the segment, along the contour thereof. These notches generally extend along generatrices of the broadened segment 42. They delimit tongues 52. The tongues 52 are only defined on the broadened segment 42.

In the vicinity of its free end, each tongue has an outer deformation forming a peripheral strip 60 provided on all of the tongues. This strip 60 defines a hollow profile member forming a channel that opens inwardly and is suitable for receiving a complementary protruding profile member provided on the other segment.

Beyond the strip 60, each tongue has a raised edge 62 that diverges toward its free end. This edge moves gradually from the axis of the segment toward its end.

Figure 5:
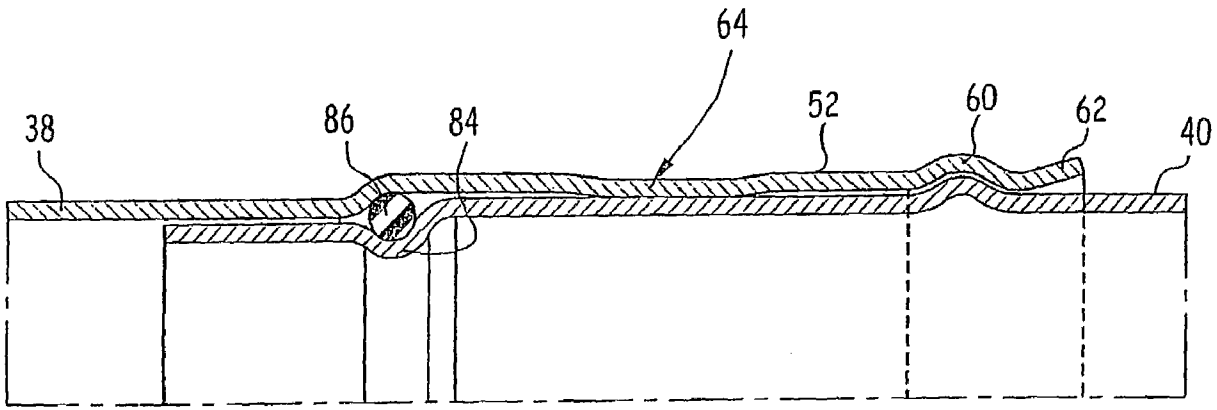
FIG. 5 is a larger-scale section of the boss from FIG. 4, taken along the line V-V.

A boss 64, illustrated in detail in FIG. 5, is provided in the middle part of each tongue. This boss 64 is formed by means of embossment of the wall, deforming said wall inwardly. The boss 64 protrudes toward the interior of the segment 38, i.e. toward the axis of this segment.

The bosses 64 reduce the area of contact between the joined segments 38 and 40.

The segment 38 also exhibits a branch 70 that is suitable for receiving a heater plug, the active part of which is arranged facing the upstream face of the particle filter.

Figure 3:
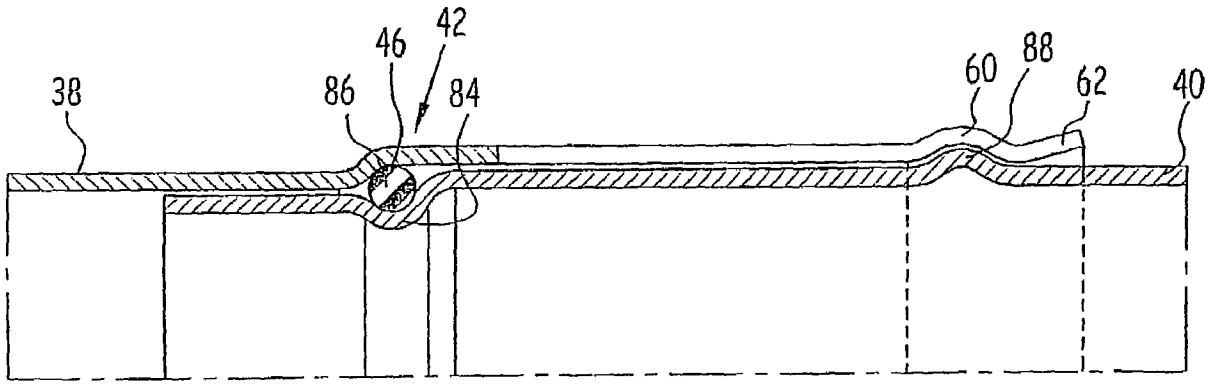
FIG. 3 is a larger-scale view of the detail marked III in FIG. 2.
Figure 6:
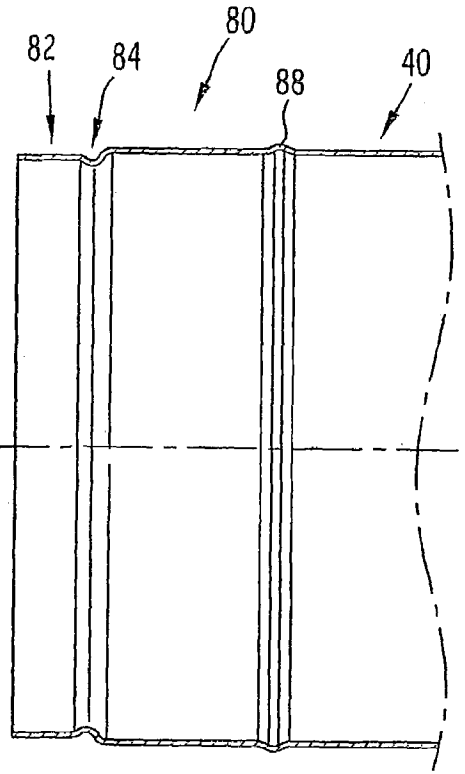
FIG. 6 is a partial longitudinal section of another segment of the casing of the depollution device.

The complementary segment 40 receiving the catalytic purification element is illustrated in isolation in FIG. 6. It comprises a main segment 80 that is consistent in section and is extended toward the free end, fitted into the segment 38, by a segment 82 having a small section. These two segments 80, 82 are connected to each other by a peripheral throat 84 for receiving an O-ring 86, as illustrated in FIG. 3. This throat opens outwardly. It is defined by centripetal deformation of the metal sheet forming the segment 40.

Finally, the main segment 80 has a peripheral strip 88 that protrudes outwardly and is adapted to be received in the channel delimited by the strip 60 of each notch.

The distance separating the shoulder 46 from the strip 60 on the first segment 38 is equal to the distance separating the throat 84 from the strip 88.

The bosses 64 are applied on the segment 40 between the throat 84 and the strip 88. The surface of the segment 40 on which the bosses are applied is smooth. In a variant, the surface of the segment 40 between the throat 84 and the strip 88 has hollows for receiving the bosses 64, thus angularly positioning the segments 38 and 40 by fitting the bosses into the hollows, as a result of the complementary nature of their shapes.

Furthermore, strapping 90 surrounds the inner and outer segments in the overlapping region thereof.

The strapping 90 comprises a tightening band 92 forming an open loop, the two ends of which are connected to each other by a traction mechanism 94 comprising a tightening screw 94, for example. This screw draws the two ends of the band 92 together.

The strapping 90 radially deforms the tongues, pressing them against the outer surface of the inner segment. It also compresses the O-ring 86, which improves the tightness between the segments 38 and 40.

The contact between each tongue and the outer surface of the inner end of the segment 40 takes place along the peak of each protrusion 64, as illustrated in FIG. 6.

With a device of this type, it will be understood that although the upstream face of the particle filter will be soiled by ashes after a given operating time of the engine, it is possible to act on the vehicle in order to clean the particle filter.

For this purpose, the device 10 is first of all detached from the exhaust line of the vehicle. In order to detach the two successive segments 38, 40, the traction mechanism 64 is first of all loosened, allowing the strapping 46 to be withdrawn.

Once the strapping has been withdrawn, a hose for conveying air under pressure is connected to one of the branches 70, once the plug that was initially present has been withdrawn. Air under pressure, and in particular at a pressure between 2 and 8 bars, is introduced into the exhaust chamber, in the space defined between the upstream face of the particle filter and the downstream face of the catalyst.

The increase in pressure in this space causes the two segments forming the exhaust chamber to become detached, as a result of the significant loss of pressure caused by the particle filter and the catalytic purification element. The force resulting from the pressure is greater than the force required to deform the tongues in order to uncouple the complementary protruding and hollow profile members, and also than the force required to break any bonds caused, in particular, by the corrosion that may have taken place between the tongues and the outer surface of the inner end.

In the event of excessive bonding of the tongues and the outer surface of the inner end, the divergent ends 62 of each tongue allow a lever-forming implement such as a screwdriver, for example, to be easily introduced between each tongue and the inner end.

The opening of the casing along the transverse break 34 allows access to the upstream face of the particle filter 20, this face being turned toward the purification member 18.

A nozzle for injecting air or a suitable fluid is applied downstream of the particle filter. The ashes retained on the upstream surface of the filter are evacuated under the effect of the air or the fluid circulating in counter-current through the particle filter.

After cleaning of the upstream face of the particle filter, the two segments of the device are reassembled. The divergent edges 62 allow the inner segment to be inserted between the tongues by defining together a truncated surface promoting guiding and joining of the inner segment. The strapping 90 is then put back in place. The device is then reassembled on the exhaust line of the vehicle.

Figure 7:
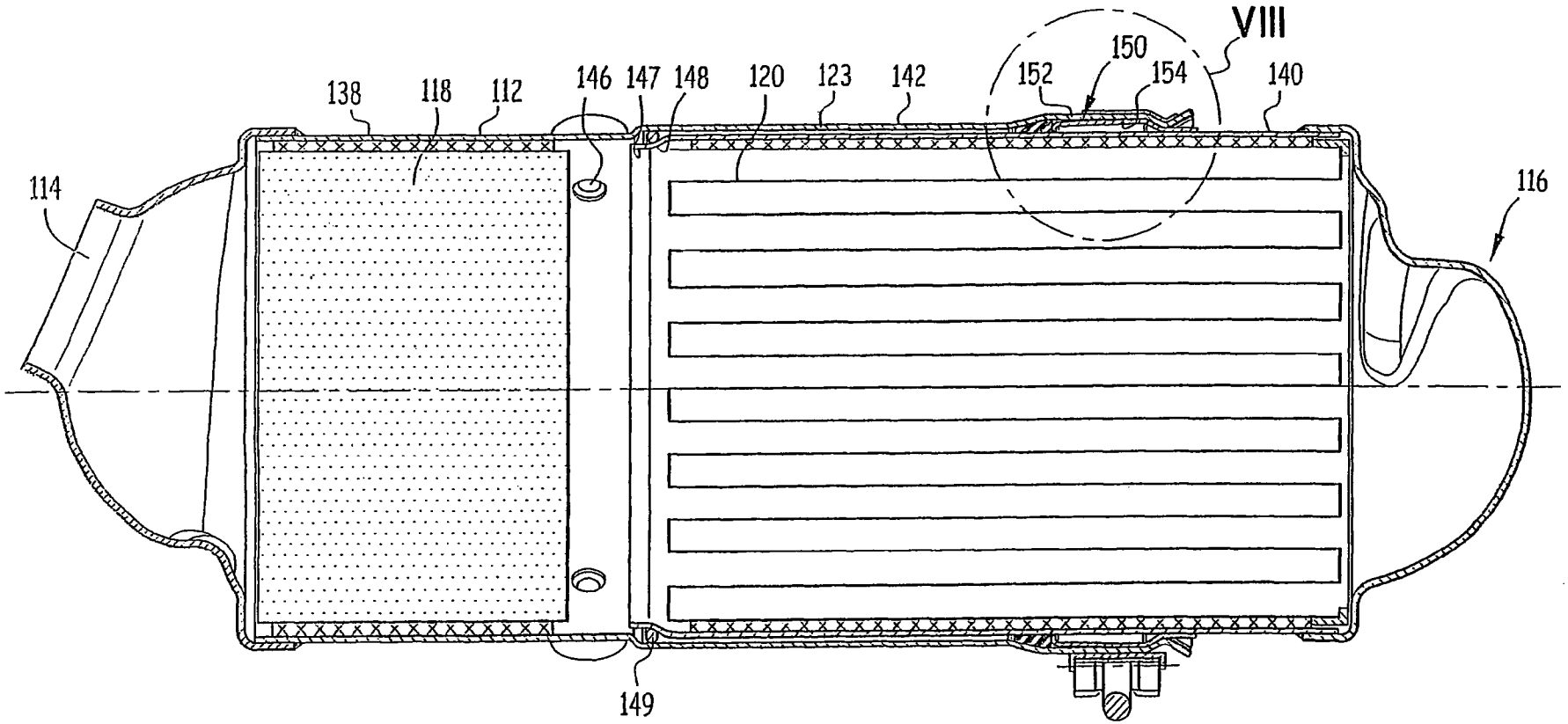
FIG. 7 is a longitudinal section of a variation of a depollution device according to the invention.
Figure 8:
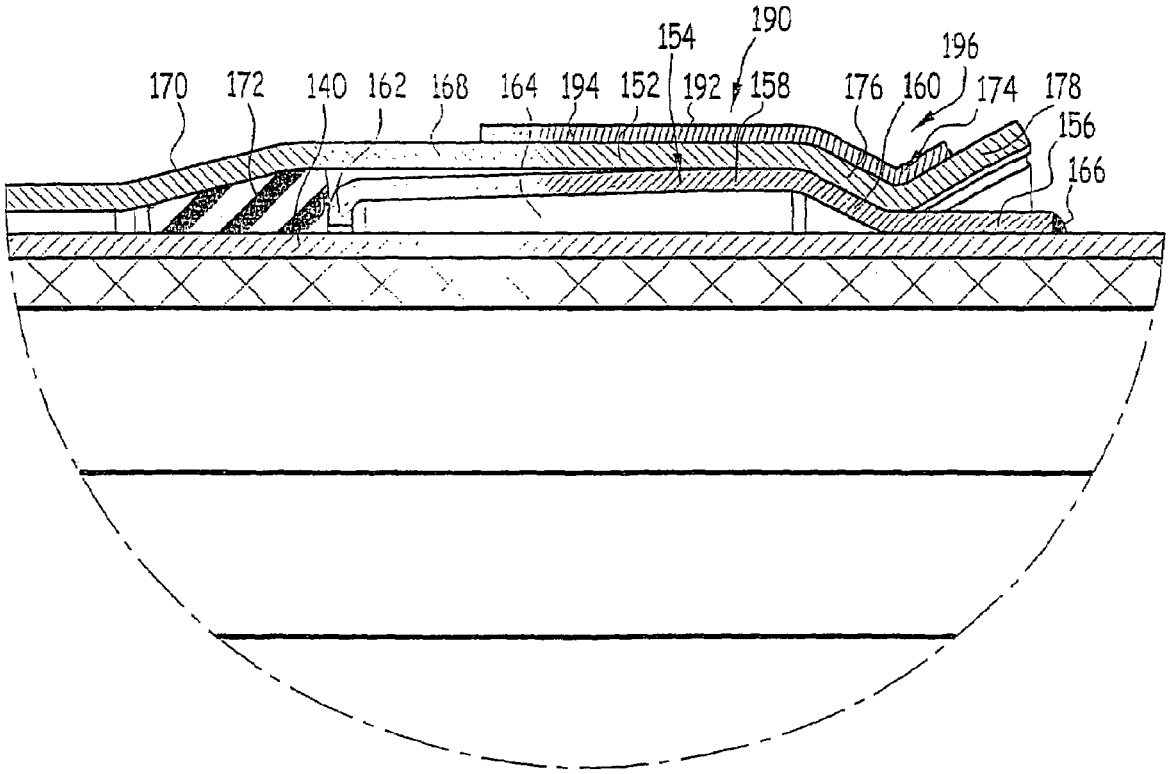
FIG. 8 is a larger-scale partial view of the detail marked VIII in FIG. 7.

FIGS. 7 and 8 illustrate a variation of a depollution device, marked 110. As was the case above, the device comprises an exhaust pipe 112 having an inlet 114 and an outlet 116, between which a catalytic purification member 118 and a particle filter 120 are arranged.

The exhaust pipe 112 forms a casing 123. Said casing comprises two successive segments 138, 140. The catalytic purification member 118 is received in the segment 138, while the particle filter 120 is received in the segment 140.

The segment 140 is fitted inside the corresponding end of the casing segment 138.

For this purpose, the casing segment 138 has a broadened end segment 142 having a larger diameter than the common part of the segment 138, in which the catalytic purification member 118 is received. The broadened segment is suitable for receiving the end of the casing segment 140. A shoulder 146 is defined between the broadened segment 142 and the common part of the segment 138.

At its free end, the segment 140 has a constriction 147 defining a shoulder 148 extending opposite the shoulder 146. A sealing O-ring 149 is arranged between the two shoulders.

According to the invention, the free end of the broadened segment 142 has weakened zones allowing variation of the cross-section of this end and, more precisely, centripetal deformation of this end.

The weakened zones comprise notches 150 distributed uniformly at the outer end of the segment, along the contour thereof. These notches delimit tongues 152.

The segment 140 is generally consistent in section. At its periphery, in line with the tongues 152 when the two segments are fitted, it comprises a peripheral strip comprising a metal collar 154 attached by welding to the wall of the segment 140.

This collar comprises in section a connection area 156 that is generally cylindrical and is extended by a cylindrical support area 158 arranged at a distance from the wall of the segment 140. The support area 158 is connected to the connection area 156 by a retaining front 160 that is generally truncated.

At its free end, the support area 158 has a folded edge 162 that is directed toward the wall 140 and held at a distance therefrom. The generally cylindrical support area 158 is thus only connected to the wall of the segment 140 by one side and extends along this wall in an overhanging manner.

An interval 164 is delimited between the wall 140 and the support area 158.

The collar 154 forming the strip is connected to the wall of the segment 140 by a weld 166 provided at the end of the connection area 156. This weld is provided on the side opposite the fitting side of the two segments 138, 140.

As illustrated in FIG. 8, the tongues 152 are outwardly radially deformed and are connected to the common part of the broadened segment 142 by a truncated portion 170 delimiting a shoulder, for supporting a toroidal seal 172 received between this truncated segment and the folded edge 162.

At its free end, each tongue comprises an inward-pointing constriction 174, which delimits an inclined surface 176 that is suitable for resting on the truncated retaining front 160. This inclined surface is extended by a raised edge 178. The areas 176, 178 delimit between them a revolution channel this is generally V-shaped.

In order to hold the two assembled segments, the device comprises strapping 190 comprising a tightening band 192 and means (not shown) for pulling this band. The tightening band has a main plane support area 194 on the main surface of the tongues 152. On its lateral edge, the band 192 has a peripheral constriction 196 having a suitable shape for engaging with the constriction 174 of each of the tongues. More precisely, the constriction 196 generally has a V-shape in section that is suitable for being applied to the areas 176 and 178 of the tongues and thus for holding the constricted end of the tongues in support on the truncated surface 160 of the strip 154. When the tongues are engaged on the peripheral strip, the main surface of the tongues is supported on the resilient support surface 158 of the collar 152.

It will be understood that, in this embodiment, the presence of the strip 154 providing a front 160 for retaining the constricted end of the tongues, in conjunction with the particular shape of the strapping band ensuring that the constriction of the tongues is maintained behind the front 160, ensures that the performance of the assembly is satisfactory. Moreover, the presence of a seal 172, inserted between the shoulder defined by the truncated area 176 and the strip 154, ensures satisfactory tightness.

Since the support area 158 extends in an overhanging manner above the wall delimiting the segment 140, said wall provides resilience that ensures satisfactory retention of the strapping 190.

The invention claimed is:

1. Device for depolluting the exhaust gases of a heat engine comprising an outer casing (23; 123) delimiting a passage for the circulation of exhaust gases and a particle filter (20; 120) mounted in said passage, said casing (23; 123) comprising a transverse break (34) along all of its periphery, which break (34) divides the casing (23; 123) into successive first and second segments (38, 40; 138, 140), the first and the second successive segments (38, 40; 138, 140) comprising mutually engaged ends, one outer end of the first segment (38; 138)

overlapping one inner end of the second segment (40; 140) along part of the length of the circulation passage, characterised in that the outer end of the first segment (38; 138) comprises along its periphery at least one weakened zone (52; 152) allowing variation of the cross-section of said outer end of the first segment (38; 138), a plurality of weakened zones distributed along the periphery of the first segment (38; 138), which zones define between them support tongues (52; 152) on the inner end of the second segment (40; 140).

2. Device according to claim 1, characterised in that the tongue or each tongue (52; 152) comprises a divergent edge (62; 178) provided at its free end, which edge (62; 178) gradually moves from the second segment (40; 140) toward its free end.

3. Device according to claim 1, characterised in that the tongue or each tongue (52) comprises a boss (64) protruding toward the second segment (40), which boss (64) rests on the inner end of the second segment (40).

4. Device according to claim 1, characterised in that the ends of the first and second segments (38, 40) comprise complementary protruding and hollow profile members (60, 88) for axially retaining the first and second segments (38, 40).

5. Device according to claim 1, characterised in that it comprises strapping (90; 90) surrounding the first and second segments (38, 40; 138, 140) in the overlapping region thereof.

6. Device according to claim 5, characterised in that it comprises an O-ring (86; 149) inserted between the inner and outer ends of the first and second segments (38, 40; 138, 140).

7. Device according to claim 1, characterised in that the end of the upstream segment (40), viewed in the normal direction of flow into the circulation passage, extends inside the end of the downstream segment (38), viewed in the normal direction of flow into the circulation passage.

8. Device according to claim 1, characterised in that it comprises a catalytic purification member (18; 118), said transverse break (34) being provided between the particle filter (20; 120) and the catalytic purification member (18; 118).

9. Device according to claim 1, characterised in that the outer casing (23) comprises a branch (70) opening into said circulation passage upstream of the particle filter (20).

10. Device according to claim 1, characterised in that the second segment (140) comprises an attached outer collar (154) forming a peripheral strip on which said tongues (152) rest.

11. Device according to claim 10, characterised in that said collar (154) has a support area (158) that is only connected on one side to the wall delimiting the second segment (140), which support area (158) extends in an overhanging manner along the wall delimiting the second segment (140).

12. Device according to claim 10, characterised in that each tongue (152) has a constriction (174) that is supported behind the peripheral strip formed by the outer collar (154).

13. Device according to claim 5, further comprising a plurality of weakened zones distributed along the periphery of the first segment (38; 138), which zones define between them support tongues (52; 152) on the inner end of the second segment (40; 140), each tongue (152) having a constriction (174) that is supported behind the peripheral strip formed by an outer collar (154), characterised in that the strapping (190) comprises a portion that is suitable for engaging with said constriction (174) of each tongue (152) behind the peripheral strip formed by the outer collar (154).

14. Method for dissociating the first and second segments (38, 40) of a device according to claim 9, characterised in that it comprises a step involving the injection, into said circulation passage, of a fluid under pressure through said branch (70), in order to urge the first and second segments in opposite directions.

15. Device according to claim 1, characterised in that the tongue or each tongue (52; 152) comprises a divergent edge (62; 178) provided at its free end, which edge (62; 178) gradually moves from the second segment (40; 140) toward its free end.

16. Device according to claim 2, characterised in that the tongue or each tongue (52) comprises a boss (64) protruding toward the second segment (40), which boss (64) rests on the inner end of the second segment (40).

17. Device according to claim 2, characterised in that the ends of the first and second segments (38, 40) comprise complementary protruding and hollow profile members (60, 88) for axially retaining the first and second segments (38, 40).

18. Device according to claim 3, characterised in that the ends of the first and second segments (38, 40) comprise complementary protruding and hollow profile members (60, 88) for axially retaining the first and second segments (38, 40).

19. Device according to claim 1, characterised in that it comprises strapping (90; 90) surrounding the first and second segments (38, 40; 138, 140) in the overlapping region thereof.

* * * * *